US005400485A

United States Patent [19]

Bialostozky-Krichevsky

[11] Patent Number: 5,400,485

[45] Date of Patent: Mar. 28, 1995

[54] APPARATUS FOR MANUFACTURING IMITATION JACQUARD FABRIC

[75] Inventor: Abraham Bialostozky-Krichevsky, Sierra Guardarrama, Mexico

[73] Assignee: Terpel, S.A. De C.V., Tacuba, Mexico

[21] Appl. No.: 1,574

[22] Filed: Jan. 6, 1993

[30] Foreign Application Priority Data

Mar. 30, 1992 [MX] Mexico ..... 9201435

[51] Int. Cl.[6] ..... D06C 23/00; D06B 1/02

[52] U.S. Cl. ..... 28/163; 28/167; 26/69 R

[58] Field of Search ..... 28/140, 163, 165, 167; 26/69 R; 101/32, 23, 3.1, 114, 119, 129

[56] References Cited

U.S. PATENT DOCUMENTS

| | | | |
|---|---|---|---|
| 146,674 | 1/1874 | Hebdon | 28/165 |
| 3,494,821 | 2/1970 | Evans | 28/105 |
| 3,613,186 | 10/1971 | Mazzone et al. | 26/69 R |
| 3,942,438 | 3/1976 | Zimmer | 101/119 |
| 4,444,104 | 4/1984 | Mitter | 101/119 |
| 4,499,637 | 2/1985 | Greenway | 28/163 |
| 5,148,583 | 9/1992 | Greenway | 28/163 |
| 5,202,077 | 4/1993 | Marco et al. | 28/167 |
| 5,235,733 | 8/1993 | Willbanks et al. | 26/69 R |

FOREIGN PATENT DOCUMENTS

| | | | |
|---|---|---|---|
| 0200378 | 12/1986 | European Pat. Off. | 28/163 |
| 0259540 | 8/1988 | Germany | 28/163 |

*Primary Examiner*—Clifford D. Crowder
*Assistant Examiner*—Amy Brooke Vanatta
*Attorney, Agent, or Firm*—Ladas & Parry

[57] ABSTRACT

Apparatus and process for the manufacture of imitation Jacquard fabric by passing a flocked fabric through a printing station whereat a selected drawing or design is printed on the fabric by pressurized air. The flocked fabric is moved on a table beneath a rotatable drawing cylinder extending transversely to the table and spaced from the table only by a distance to allow the passage of the fabric therebetween. A stationary tube is placed within the drawing cylinder and the tube is supplied with pressurized air which passes into the drawing cylinder. The pressurized air passes through apertures in the drawing cylinder correlated with the design to be printed onto the fabric. The fabric is advanced under tension by rollers and a driving assembly rotates the drawing cylinder and at least one of the rollers.

12 Claims, 5 Drawing Sheets

APPARATUS FOR MANUFACTURING IMITATION JACQUARD FABRIC

BACKGROUND OF THE INVENTION

The invention concerns an apparatus and process for the manufacture of imitation Jacquard material, said apparatus being connected to a flocking line to print a selected design on the fabric.

Jacquard is a material manufactured by a combination of loom and small Jacquard apparatus, which consists in a highly sophisticated machine with a hook which, by means of a mechanical or electronic-type drawing, moves the thread in the weave on the loom in such a way that the weft passes, manufacturing in this way the desired design. This process is highly sophisticated and very costly, since it involves not only the loom but also makes use of peripheral equipment necessary to complete other steps such as, for example, the "pricking" of the drawing and preparation of the fabric, such as warping, sticking, fastening, etc.

The conventional process for Jacquard manufacture makes use of a weaving room with air conditioning essential in order to maintain a controlled humidity and temperature, and the hourly production of this fabric does not correspond to the investment necessary to produce it since, as compared with other types of materials, production is very low and for this reason the cost is usually high.

SUMMARY OF THE INVENTION

The apparatus of the present invention has been conceived in order to cover the demand existing in the fabric market for upholstery and decoration which, without being as expensive as the authentic Jacquard, can compete favorably as an imitation thereof. For such purpose, the apparatus is connected to a flocking line for printing the fabric with a pre-selected design and to continuously produce large quantities of imitation Jacquard fabric at substantially reduced production costs. The apparatus also offers the possibility of printing any design on the flocked material without the production volume increasing costs in the preparation of this imitation Jacquard material.

As regards the structure of the apparatus, it comprises a table or base over which the flocked material is moved for printing thereon the desired design by a printing means which includes a drawing cylinder containing inside it a tube having means for the exit of pressurized air. The cylinder contains perforations which correspond to the form of the design selected for printing on the fabric, through which the pressurized air is projected on the fabric as the latter moves uniformly at a suitable tension which is obtained by a mechanism consisting of first and second rollers placed, respectively, at the entry and exit ends of the apparatus. The apparatus also comprises a source for supplying pressurized air, which source is connected to the tube placed inside the cylinder, and a driving assembly for spinning the drawing cylinder and at least the roller located at the exit end of the apparatus.

The advantages of the invention, will be clearly evidenced from the detailed description referred to the following drawings.

DESCRIPTION OF THE DRAWINGS OF THE INVENTION

DETAILED DESCRIPTION OF THE PREFERRED EMBODIMENT OF THE INVENTION

Figure 1:
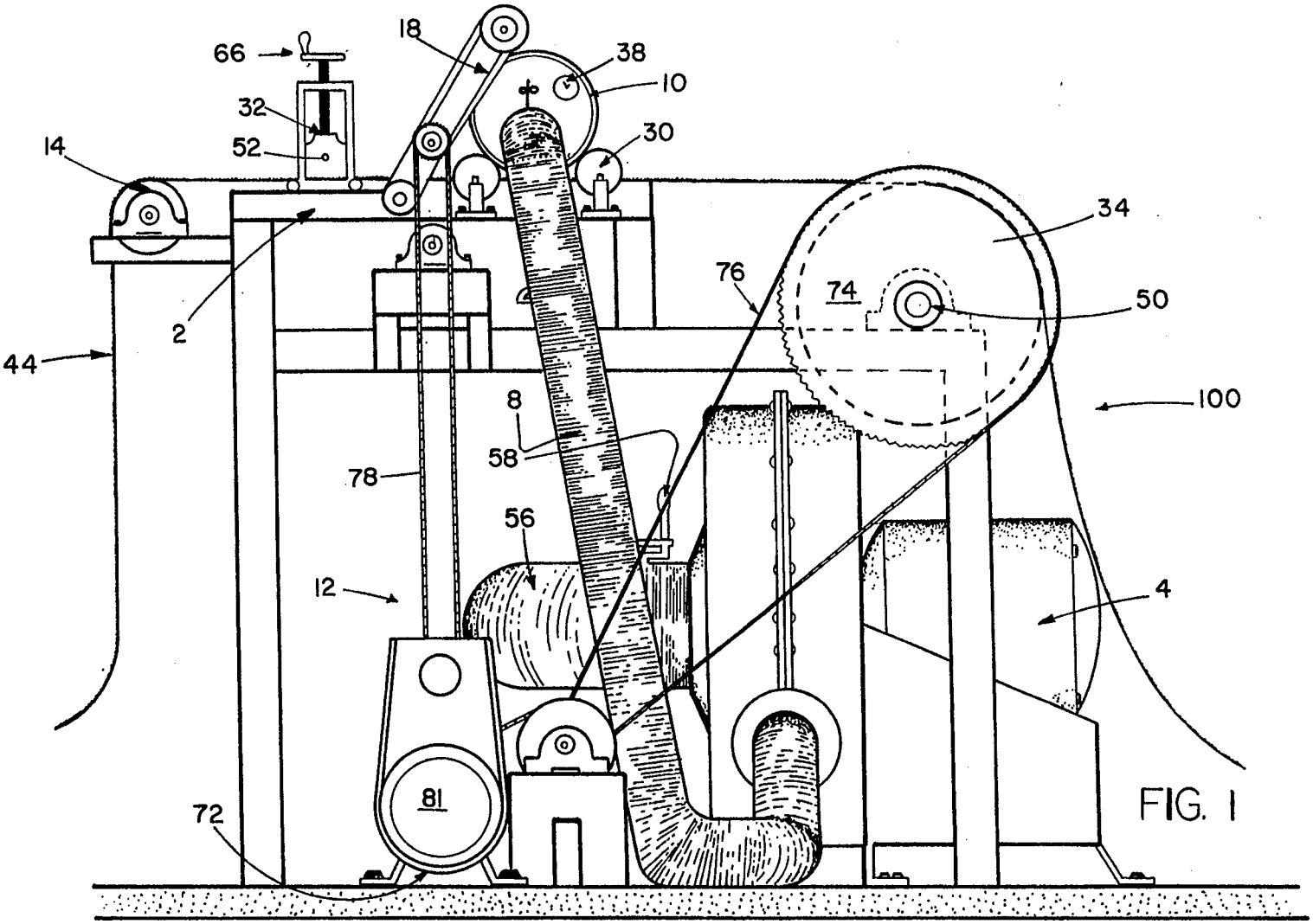
FIG. 1 is a side view of the apparatus for manufacturing imitation Jacquard fabric.
Figure 2:
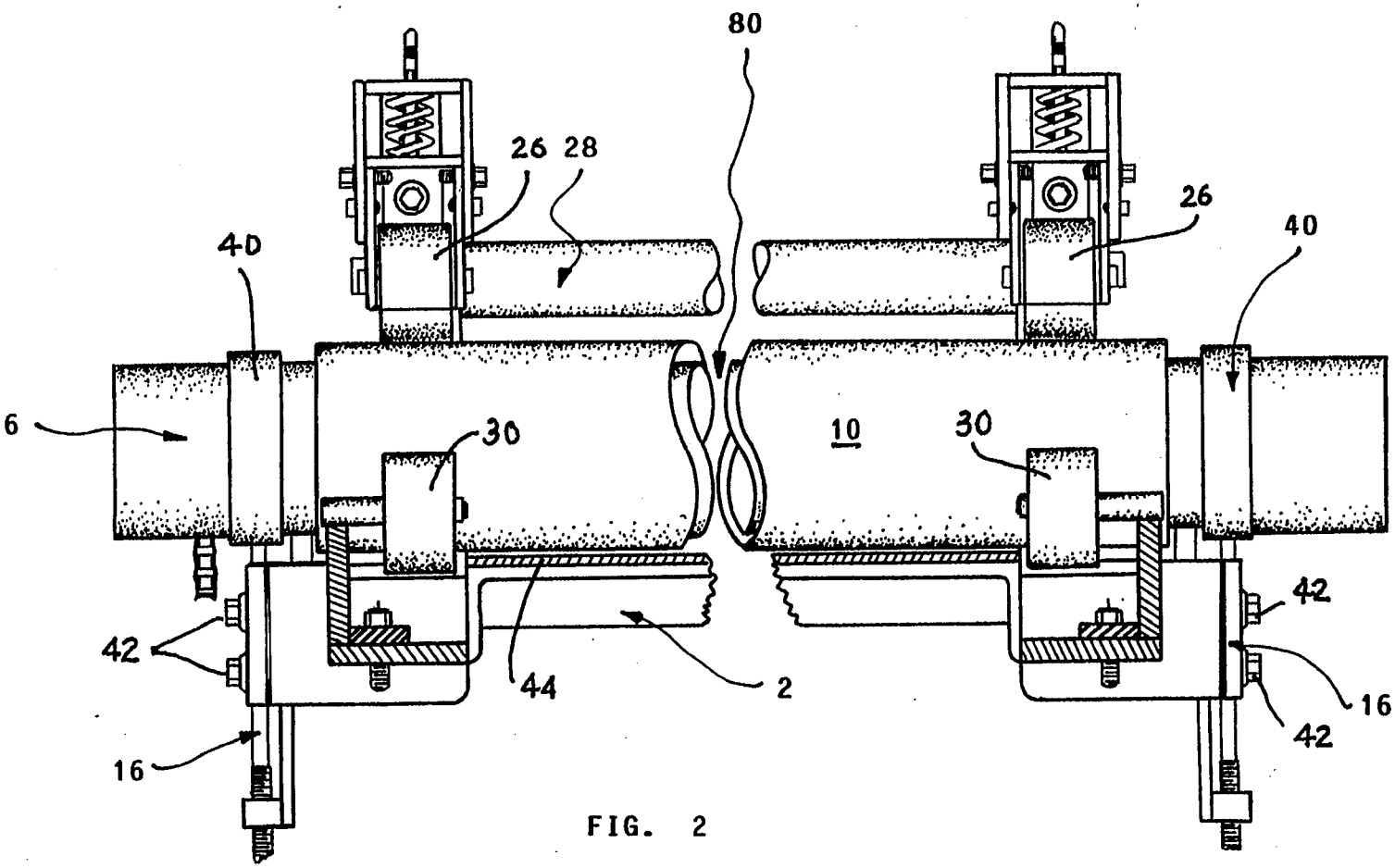
FIG. 2 is a front view of the apparatus.
Figure 3:
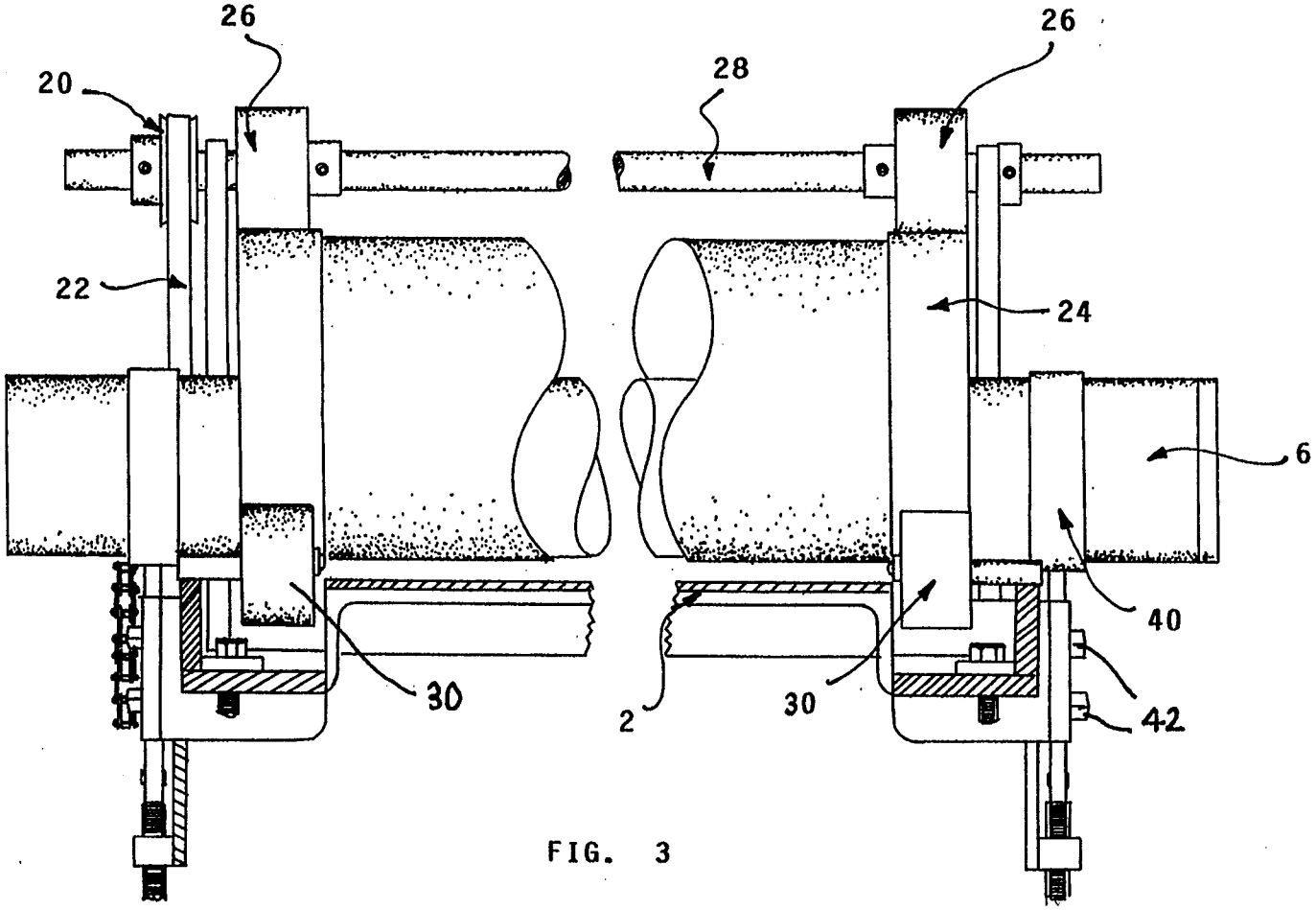
FIG. 3 is a rear view of the apparatus.
Figure 4:
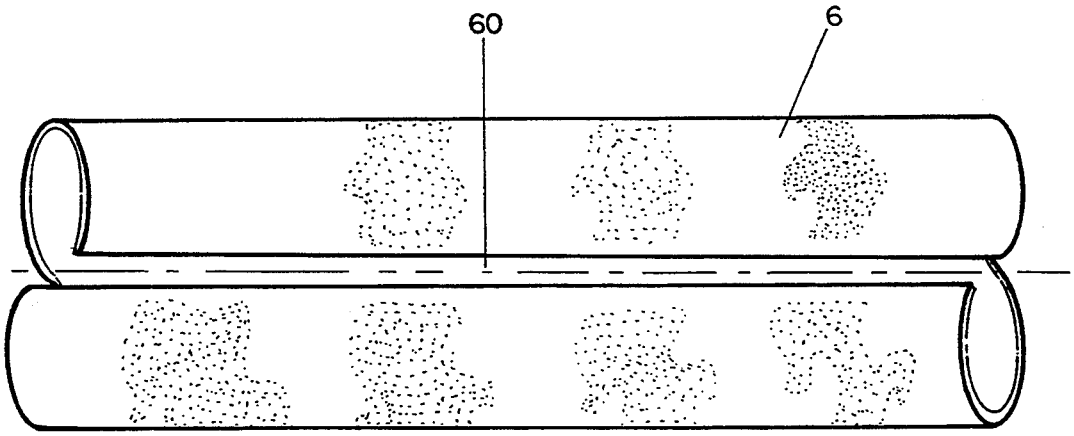
FIG. 4 shows the tube including means for the exit of air under pressure.
Figure 5:
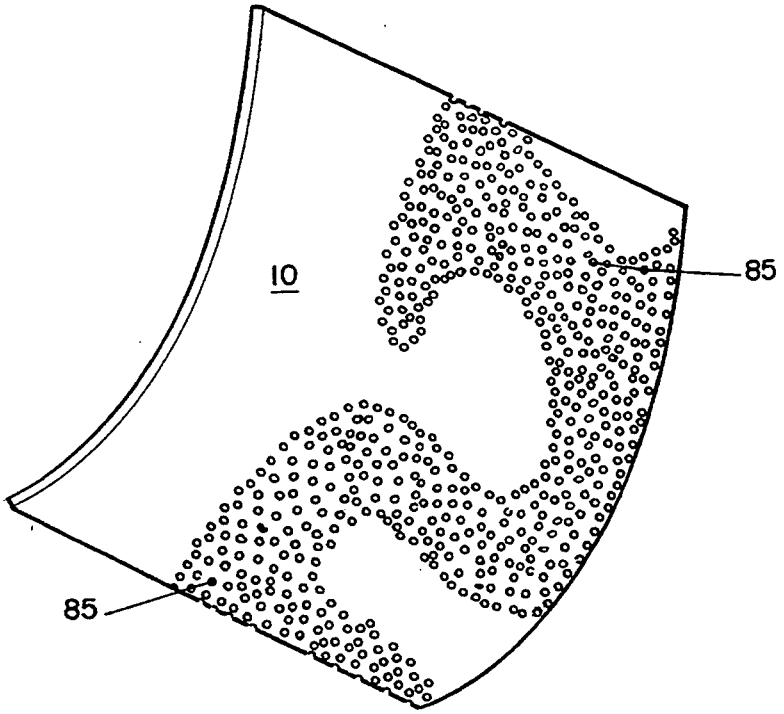
FIG. 5 is a fragmentary view of the drawing cylinder of the apparatus showing multiple perforations for the exit of air under pressure.

Apparatus 100 consists, in its preferred embodiment, of a base or table 2 which serves as a structural support and over which the flocked material 44 being supplied to said apparatus moves for the manufacture of imitation Jacquard fabric by printing of a pre-selected design or drawing on material 44. For such purpose, a printing means 80 is placed over table 2 in a transverse position thereto.

Printing means 80 comprises a drawing cylinder 10 which has a plurality of perforations 85, the length of means 80 being roughly equivalent to that of the surface of base 2 through which the fabric moves. A tube 6 is placed within drawing cylinder 10 and includes means 60 for the exit of air under pressure towards said cylinder 10.

A pressurized air source 4 is in communication with tube 6 through air duct 8 to supply air under pressure to said tube. Tube 6 is secured firmly in its position within cylinder 10 by means of sleeves 40 and fixing screws 42 provided at each end of said tube, it being possible to vary the distance between said tube 6 and the internal surface of cylinder 10 by means of a regulation mechanism 16 which is used for the aim hereinafter described.

Drawing cylinder 10 is supported for rotation on a pair of rotating disks 30, lined with rubber and without relative traction movement. The disks 30 are, placed close to each end of cylinder 10 which, in this region, includes a ring 24 to make bearing contact with said disks 30. The apparatus includes a driving assembly 72 to provide a revolving movement to drawing cylinder 10, which driving assembly 72 consists of a driving arm 18 driven from an engine 81 via a transmission 12. Arm 18 is secured on one side of base 2 and includes a plate 46 fastened to the base on one end, a first axle 82 emerging from said plate on which a gear 83 and a first pulley 62 are mounted, said gear 83 receiving a rotating drive from of the engine via transmission 12, so that pulley 62 rotates with gear 83. A second pulley 20 is drivingly connected to pulley 62 by means of a band 22 in such a way that pulley 20 drives an axle 28 which extends across the base, and on which rubberized wheels 26 are mounted. The wheels 26 rest on the rings 24 of the drawing cylinder, whereby the turning movement of the wheels 26 cause the cylinder 10 to turn in the opposite direction of wheels 26, but in the direction of movement of flocked material 44.

In order to ensure that flocked material 44 moves at a suitable tension for printing the design on the material, first and second rollers 14 and 34 are placed, respectively, at the entry and the exit end of the apparatus. Both rollers are covered with a tractive card the inclination of which in one roller and the other is inverse for the purpose of suitably tensing the flocked material 44, that is, on roller 14 the tractive card is inclined against the movement of the fabric, while the inclination of said card on roller 34 is in the same direction as the movement of the fabric.

At an intermediate point between roller 14 and drawing cylinder 10, a chrome guiding roller 32 is placed which serves to guide the direction of flock hair before the fabric passes under cylinder 10. The guiding roller 32 has a peg 52 at each end which is supported on bearing 48 placed on table 2; a mechanism 66 serves for adjusting the height of roller 32 with respect to the horizontal plane of the table.

Drawing cylinder 10 is a stainless steel tubular element having multiple perforations 85 through which the pressurized air is projected towards the displaceable flocked material 44, the disposition of said perforations corresponding to the design of the drawing on cylinder 10 which it is desired to print on the fabric. The pressurized air which emerges through the perforations of cylinder 10 is injected by source 4 to tube 6 and exits from said tube towards cylinder 10 through the pressurized air exit 60, which consists of a lengthwise groove facing towards table 2 and extending substantially for the entire length of tube 6. Air exit 60 has a divergent configuration, that is, it becomes wider as it becomes more distant from the end of the tube at which the air under pressure is injected.

Depending on the depth desired for the design on the fabric to be manufactured, the height of tube 6 will be adjusted by means of height regulating mechanism 16. The diameter of drawing cylinder 10, which is a component of the printing means, can be of any size as required, and this feature represents no problem for the assembly of said cylinder since the base of the rotary supporting wheels 30 has an opening and closing mechanism 68 which is supported on sliding elements which allow the height of the wheels to be adjusted in accordance with the diameter of cylinder 10. The apparatus also has guide bearings 36 placed on the driving arm 18, which act as stop members engaging the ends of the cylinder 10 in order to prevent lateral movement thereof.

Figures 6, 7:
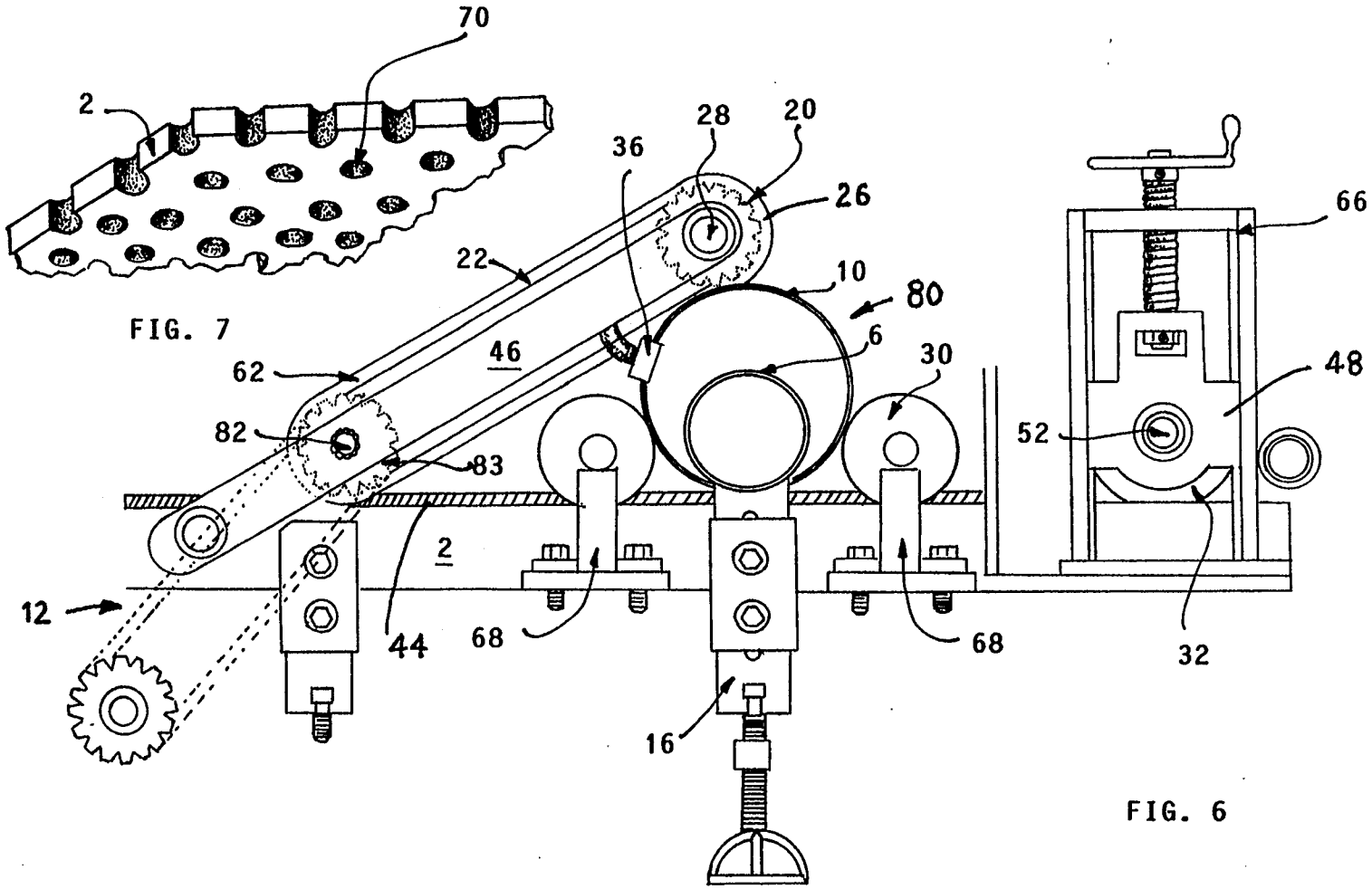
FIG. 6 shows a driving arm of the driving assembly in a modified arrangement of the apparatus.
FIG. 7 is an enlarged portion of the table or base of the apparatus.

On the other hand, to prevent the raising or waving of flocked material 44 when passing through the air injection area, where the rotating drawing cylinder 10 is located, the table or base 2 has multiple orifices 70 (FIG. 7) through which the air injected under pressure on the fabric escapes towards the lower section of table 2, thereby ensuring that the fabric 44 remains on the upper surface of said table when moving on the table during the printing process.

In order to obtain high quality imitation Jacquard material, it is important that the printing of the design on the fabric be carried out with a uniform speed of the drawing cylinder. To achieve this, the apparatus includes a transmission mechanism joined to driving assembly 72 so that rotational drive is imparted both to roller 34 and drawing cylinder 10. Roller 34, which moves in the same direction as the material 44, is supported at its ends in bearings 50 on table 2, said roller 34 receiving drive from driving assembly 72 by means of an toothed wheel 74 mounted on the same axle on which said roller 34 rotates. For transmitting the drive movement from assembly 72 to toothed wheel 74, a chain member 76 is utilized. Similarly, driving arm 18, which turns cylinder 10, is connected to the assembly 72 by means of another chain 78 which is connected to a gear mechanism.

It is further important to maintain strict control over the air pressure injected by supply source 4 to tube 6 and therefore an air pressure meter 38 (FIG. 1) is disposed at the entry of said tube for verifying that the apparatus is operated at a suitable air pressure. Pressurized air supplying source 4, in the embodiment described herein, consists of a fan to which a hose 56 is connected whose other end is in communication with outside air to provide air to the fan. An air-regulating valve 58 controls the rate of air which enters the fan.

With regard to the process for the manufacture of imitation Jacquard fabric, this is carried by using the apparatus described herein-above which is placed in a flocking line. The process is characterized by the steps of:

a) choosing the design to be printed on the fabric, and placing the corresponding drawing cylinder 10 in apparatus;

b) Adjusting the height of the tube 6 placed within the drawing cylinder with respect to the internal surface of the cylinder 10;

c) operating the apparatus;

d) displacing a flocked fabric along the table or base 2 of the apparatus;

e) inclining the flock of the fabric to be printed with the chrome roller 32 before the fabric passes through a printing station; and f) injecting pressurized air over the fabric by said drawing cylinder to produce printed design on the fabric.

During the foregoing process, it is important to take into consideration certain aspects such as the movement of the fabric at a uniform speed and that, moreover, said fabric is maintained at the suitable tension by means of the rollers 14,34 located at the entry and exit ends of the apparatus. Another important aspect for obtaining a high quality design on the fabric is to keep the air pressure in the drawing cylinder at a constant valve.

Although the invention has been described in its preferred construction and in accordance with tile attached drawings it should be evident to one skilled in the art that other modifications can be made within the inventive concept herein described, without departing from the spirit of the invention. The preceding description should therefore be considered as the best way of carrying out the invention, without this being interpreted in a restrictive manner but rather as an exemplification.

I claim:

1. An apparatus for the manufacture of imitation Jacquard fabric, comprising:

a table on which a flocked fabric is passed, said table having a plurality of orifices;

printing means for printing a selected design on the fabric by pressurized air, said printing means being disposed above the table;

a pressurized air source to provide the printing means with pressurized air; and drive means for said printing means and for advancing said flocked fabric on said table;

said printing means comprising a rotatable drawing cylinder having a multiplicity of perforations, said drawing cylinder extending transversely of the table, and a tube inside said drawing cylinder and connected to said air source;

said tube having a groove which extends from one end of the tube to an opposite end of the tube to provide air flow communication between said tube and said drawing cylinder; and said groove widening as the groove extends from said one end of the tube to said opposite end of the tube, said pressurized air being supplied to said tube at said one end.

2. The apparatus of claim 1, further including means at each end of the tube for adjusting a spacing of the tube with respect to the drawing cylinder and for keeping said tube immobile.

3. An apparatus for the manufacture of imitation Jacquard fabric, comprising:

a table on which a flocked fabric is passed, said table having a plurality of orifices;

printing means for printing a selected design on the fabric by pressurized air, said printing means being disposed above the table; and a pressurized air source to provide the printing means with pressurized air;

drive means for said printing means and for advancing said flocked fabric on said table;

said printing means comprising a rotatable drawing cylinder having a multiplicity of perforations, said drawing cylinder extending transversely of the table, and a tube inside said drawing cylinder and connected to said air source;

said drive means comprising an engine, a driving arm mounted on said table in driving connection with said drawing cylinder, and a transmission drivingly connecting said engine to said driving arm.

4. The apparatus of claim 3, wherein said driving arm includes a plate having one end attached to the table; a gear mounted on a first axle supported by the plate and driven by the engine via said transmission; a first pulley mounted on said first axle for rotary drive in the same direction as said gear; a second pulley mounted on a second axle mounted at an opposite end of the plate, said second pulley being driven in rotation by said first pulley by a band connecting the pulleys, and a rubberized roller turnable on said second axle by said second pulley and engaging the drawing cylinder to rotate the drawing cylinder.

5. The apparatus of claim 4, wherein said drawing cylinder has a ring at each end thereof in bearing contact with a respective said rubberized roller mounted on said second axle.

6. An apparatus for the manufacture of imitation Jacquard fabric, comprising:

a table on which a flocked fabric is passed, said table having a plurality of orifices;

printing means for printing a selected design on the fabric by pressurized air, said printing means being disposed above the table;

a pressurized air source to provide the printing means with pressurized air; and driving means for said printing means and for advancing said flocked fabric on said table;

said printing means comprising a rotatable drawing cylinder having a multiplicity of perforations, said drawing cylinder extending transversely of the table, and a tube inside said drawing cylinder and connected to said air source;

said driving means comprising first and second rollers for applying tension to the fabric while advancing the fabric under the drawing cylinder, said first roller being disposed at an entry end of the apparatus and covered by a tractive card having tractive material inclined in a direction opposed to the direction of movement of the fabric whereby to apply tension to the advancing fabric.

7. The apparatus of claim 6, wherein said second roller is disposed at an exit end of the apparatus and is covered by a further tractive card having tractive material inclined in the direction of movement of the fabric.

8. An apparatus for the manufacture of imitation Jacquard fabric, comprising:

a table on which a flocked fabric is passed, said table having a plurality of orifices;

printing means for printing a selected design on the fabric by pressurized air, said printing means being disposed above the table;

a pressurized air source to provide the printing means with pressurized air;

drive means for said printing means and for advancing said flocked fabric on said table;

said printing means comprising a rotatable drawing cylinder having a multiplicity of perforations, said drawing cylinder extending transversely of the table, and a tube inside said drawing cylinder and connected to said air source; and means at each longitudinal side of the table including slidable elements supporting the drawing cylinder to adjust a height position of the drawing cylinder relative to said table.

9. A process for the manufacture of imitation Jacquard material which comprises the steps of:

placing a rotatable drawing cylinder above a table and providing the cylinder with apertures in an arrangement corresponding to a design to be printed on a flocked fabric on the table beneath the drawing cylinder, said drawing cylinder having a tube therewithin in air communication with the cylinder;

advancing the flocked fabric on the table and driving the drawing cylinder in rotation;

inclining flock hair of the fabric to be printed with a chrome roller before said fabric passes beneath the drawing cylinder; and injecting pressurized air into said drawing cylinder via said tube so that the pressurized air passes through the apertures in said drawing cylinder and onto said fabric as said fabric passes underneath the drawing cylinder.

10. The process of claim 9, comprising advancing the fabric beneath the drawing cylinder at a uniform speed.

11. The process of claim 9, comprising maintaining the flocked fabric at a predetermined tension as the fabric advances on the table beneath the drawing cylinder by engaging the fabric on rollers located at an entrance end and at an exit end of the table.

12. The process of claim 9, wherein the pressure of the air being applied onto the flocked fabric by the drawing cylinder is regulated and kept constant.

* * * * *